US009120194B2

(12) United States Patent
Wei et al.

(10) Patent No.: US 9,120,194 B2
(45) Date of Patent: Sep. 1, 2015

(54) APPARATUS FOR WAFER GRINDING

(75) Inventors: Kuo-Hsiu Wei, Tainan (TW); Kei-Wei Chen, Tainan (TW); Ying-Lang Wang, Tai-Chung (TW); Chun-Ting Kuo, Tainan (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 944 days.

(21) Appl. No.: 13/188,028

(22) Filed: Jul. 21, 2011

(65) Prior Publication Data

US 2013/0023188 A1 Jan. 24, 2013

(51) Int. Cl.
*B24B 7/22* (2006.01)
*B24D 7/14* (2006.01)

(52) U.S. Cl.
CPC .. *B24B 7/228* (2013.01); *B24D 7/14* (2013.01)

(58) Field of Classification Search
CPC ..... B24B 7/228; B24D 7/14
USPC ..... 451/41, 58, 63, 65, 66, 461, 527, 528, 451/529, 539, 548
See application file for complete search history.

(56) References Cited

U.S. PATENT DOCUMENTS

| | | | | |
|---|---|---|---|---|
| 2,309,016 | A * | 1/1943 | Ryan | 451/548 |
| 2,629,975 | A * | 2/1953 | Desenberg | 451/72 |
| 2,673,425 | A * | 3/1954 | Karnell | 451/548 |
| 3,299,579 | A * | 1/1967 | Jacobson | 451/266 |
| 3,885,925 | A * | 5/1975 | Tatar | 451/48 |
| 6,066,230 | A * | 5/2000 | Arai | 156/345.13 |
| 6,277,002 | B1 * | 8/2001 | Leadbeater | 451/57 |
| 6,386,956 | B1 * | 5/2002 | Sato et al. | 451/57 |
| 6,905,398 | B2 * | 6/2005 | Jeong | 451/57 |
| 7,014,540 | B2 * | 3/2006 | Nagel | 451/57 |
| 8,025,556 | B2 | 9/2011 | Kajiyama et al. | |
| 2003/0190875 | A1 * | 10/2003 | Grabbe | 451/65 |

(Continued)

FOREIGN PATENT DOCUMENTS

| | | |
|---|---|---|
| KR | 20040070492 | 8/2004 |
| TW | 415875 | 12/2000 |
| TW | 200933724 | 8/2009 |

OTHER PUBLICATIONS

Strasbaugh, "Advanced Wafer Grinding for Semiconductor, Data Storage, SOI, LED, TSV and R&D," Retrieved from http://strasbaugh.com/cm/Products/Wafer%20Grinding/7AF%20200MM%20WAFER%20GRINDER.html, Oct. 18, 2012, 2 pages.

(Continued)

*Primary Examiner* — Timothy V Eley
(74) *Attorney, Agent, or Firm* — Slater & Matsil, L.L.P.

(57) ABSTRACT

A grinding wheel comprises an outer base with a first attached grain pad; and an inner frame with a second attached grain pad; and a spindle axis shared by the outer base and the inner frame, wherein at least one of the outer base and the inner frame can move independently along the shared spindle axis; and wherein the outer base, the inner frame, and the shared spindle axis all have a same center. A grinding system comprises an above said grinding wheel, and a wheel head attached to the shared spindle axis, capable of moving vertically, in addition to a motor driving the grinding wheel to spin; and a chuck table for fixing a wafer on top of the chuck table; wherein the grinding wheel overlaps a portion of the chuck table, each capable of spinning to the opposite direction of another.

20 Claims, 3 Drawing Sheets

(56) References Cited

U.S. PATENT DOCUMENTS

2009/0191800 A1* 7/2009 Rivard et al. ..... 451/466
2009/0247050 A1* 10/2009 Arisa et al. ..... 451/5

OTHER PUBLICATIONS

Kiru-Kezuru-Migaku Technologies, "Solutions," Retrieved from http://www.disco.co.jp/eg/solution/library/thin.html, Oct. 18, 2012, 3 pages.

* cited by examiner

APPARATUS FOR WAFER GRINDING

BACKGROUND

Silicon wafers are used as the substrate to build the majority of semiconductor devices. Manufacturing of silicon wafers starts with growth of single crystal silicon ingots. A sequence of processes is used to turn a silicon ingot into wafers. A wafer can be a complete wafer or a sliced silicon (substrate) wafer. The process typically consists of the following steps: slicing, edge profiling or chamfering, flattening (lapping or grinding), etching, and polishing. Grinding is a flattening process for the surface of silicon wafers, not for the edges.

On the front side of a wafer, semiconductor devices are built. The back side of a wafer is typically thinned to a certain thickness by grinding. Such grinding the back of the wafer is simply called backside grinding, usually done by a diamond wheel. In backside grinding, the removal amount is typically a few hundred microns (in wafer thickness), and it is typically carried out in two steps: coarse grinding and fine grinding.

Coarse grinding employs a coarse grinding diamond wheel with larger diamond abrasives to remove the majority of the total removal amount required, as well as a faster feed rate to achieve higher throughput. For fine grinding, a slower feed rate and a fine grinding wheel with smaller diamond abrasives are used to remove a small amount of silicon.

A conventional grinding tool typically has multiple grinding modules, which are used to grind the backside of a semiconductor wafer 1 in various stages of the grinding process. Coarse grinding is done with a first grinding wheel at a first stage or station, and fine grinding is subsequently done with a second grinding wheel at a second stage. Movement between the two different stages or stations causes delay and misalignment issues that can impact the cost and quality of the overall process.

BRIEF DESCRIPTION OF THE DRAWINGS

For a more complete understanding of the present invention, and the advantages thereof, reference is now made to the following descriptions taken in conjunction with the accompanying drawings, in which:

FIGS. 1 (*d*)-(*f*) are schematic views of an illustrative embodiment of a grinding wheel that has its fine grinding/coarse grinding part move up, down, or none, along a same shared axis;

FIGS. 1 (*g*)-(*h*) are schematic views of illustrative embodiments of relative positions of the grinding wheel performing fine grinding or coarse grinding on a wafer.

Figure 1B:
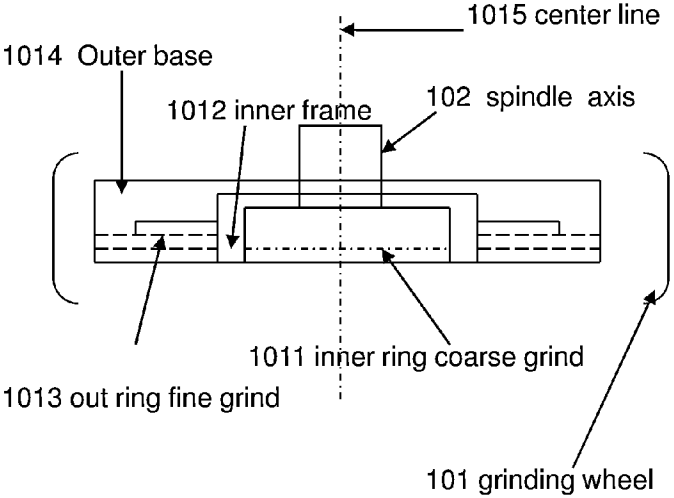
FIGS. 1 (*a*)-(*c*) are schematic views of illustrative embodiments of a grinding system with a single grinding wheel that has both coarse grinding and fine grinding capability, and an illustrative embodiment of a controller.
Figure 1C:
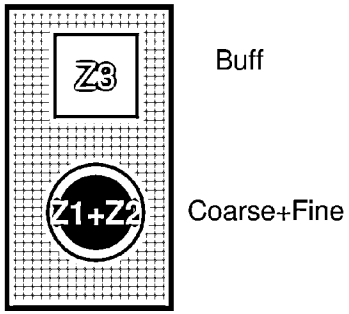
Figure 1A:
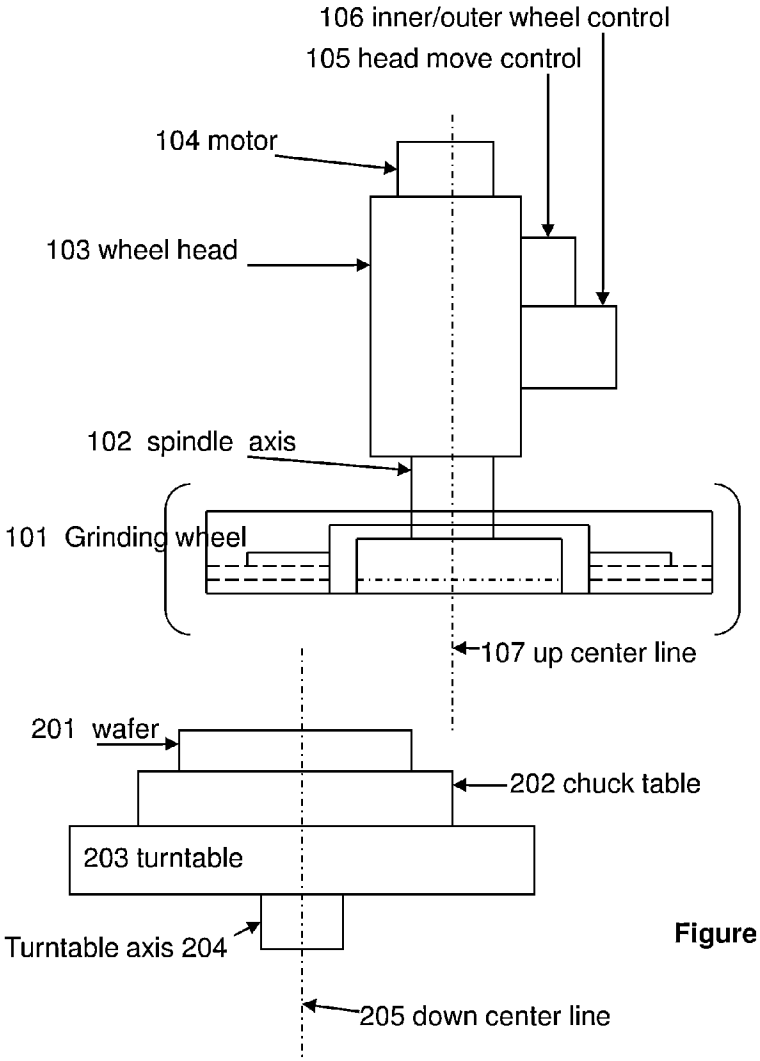
Figure 1F:
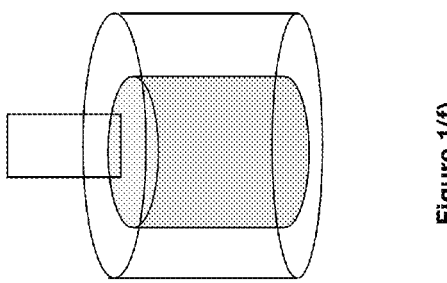
Figure 1E:
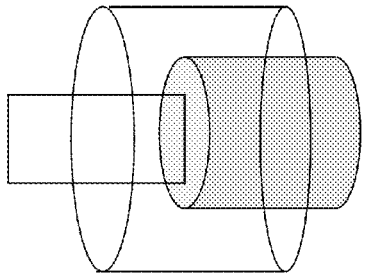
Figure 1D:
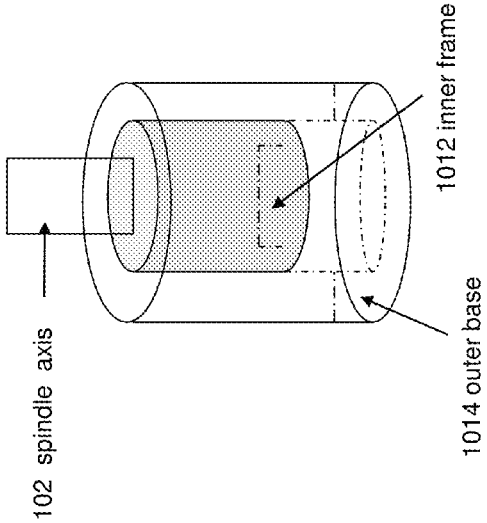
Figure 1H:
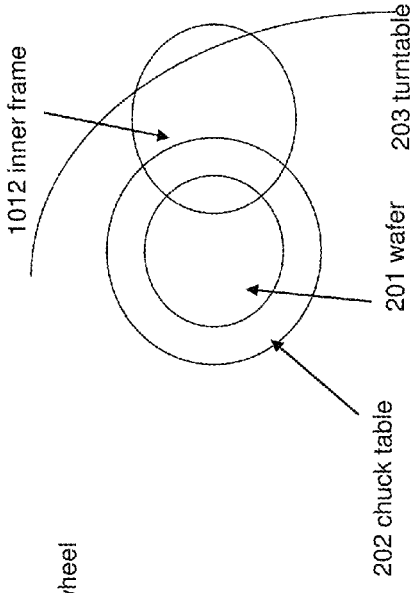
Figure 1G:
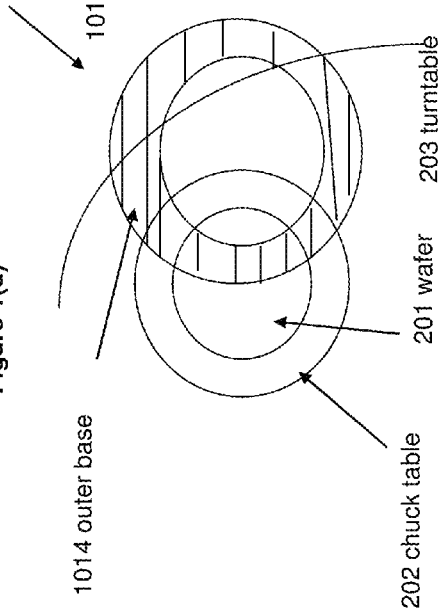

The drawings, schematics and diagrams are illustrative and not intended to be limiting, but are examples of embodiments of the invention, are simplified for explanatory purposes, and are not drawn to scale.

DETAILED DESCRIPTION OF ILLUSTRATIVE EMBODIMENTS

The making and forming of the present exemplary embodiments are discussed in detail below. It should be appreciated, however, that embodiments of the present invention provide many applicable inventive concepts that can be embodied in a wide variety of specific contexts. The specific embodiments discussed are merely illustrative of specific ways to make and use the invention, and do not limit the scope of the invention.

The present invention will be described with respect to exemplary embodiments in a specific context, namely a wafer backside grinding system, using a grinding wheel that has both coarse grinding and fine grinding capabilities.

FIG. 1(*a*) is a schematic view of an illustrative embodiment of a portion of a grinding system with a single grinding wheel 101 that has both coarse grinding and fine grinding capability. A semiconductor wafer 201 is placed by a robot or manually on a grinding chuck table 202 with the front-side down to hold the wafer 201 on the chuck table 202. The grinding chuck table 202 may hold the wafer 201 down by vacuum. A double-sided tape, or an edge clamp instead of the vacuum chuck may be used to secure the wafer 201 to the chuck table 202 as well. The grinding chuck table 202 rests on a turntable 203 that can rotate about turntable axis 204. As will be explained in more detail below, the grinding chuck table 202 spins during grinding.

A grinding wheel head 103 may be vertically movable. A grinding wheel spindle axis 102 and a grinding wheel 101 are fitted to the lower end thereof, whereas a motor 104 for driving the wheel spindle axis 102 is fitted to the upper portion thereof. The wheel spindle axis 102 is driven and rotated by the motor 104. The movement of the wheel head 103 is controlled by a control unit 105 in the system. The grinding wheel 101 is simultaneously turned and, when the wheel head is lowered, the wafer 201 on top of the chuck table is ground by the grinding wheel 101. The grinding wheel 101 is capable of being lowered by the wheel head to reach the chuck table 202 so that once a wafer is placed on the chuck table, the grinding wheel 101 can be lowered to reach the wafer regardless the thickness of the wafer. The grinding wheel 101 can perform coarse grinding and fine grinding selectively. The control unit 106 selects which grinding operation the grinding wheel 101 performs, based on various inputs from users at real time or programmed ahead of time.

During grinding, the wheel head 103 moves vertically down, so that the lower surface of the grinding wheel 101, which is its grinding pad (1013 or 1011 shown in FIG. 1(*b*)), is in contact with a portion of the semiconductor wafer 201. Preferably, the overlap of the grinding pad of the grinding wheel 101 and the semiconductor wafer 201 is at most the radius of the semiconductor wafer 201. The grinding wheel 101, moves in a counterclockwise rotation and its speed can freely adjusted, while the semiconductor wafer 201 moves clockwise. By the down movement of the wheel head 103, the wafer face 201 is ground little by little. The speed at which the wheel head 103 moves down during grinding is equal to a feed speed.

After processing is completed, the grinding wheel 101 is raised by the wheel head 103 and the turntable 203 is rotated, for example, in a clockwise direction, so that the semiconductor wafer 201 is moved to a different station on the grinding system, such as an etching station or a polishing station.

FIG. 1(*b*) is a schematic view of an illustrative embodiment of a single grinding wheel 101 that has both coarse grinding and fine grinding capability. The grinding wheel 101 has an outer base 1014 forming a cup-shaped frame, and it is so called because it looks like a cup. A first abrasive grain pad 1013 is attached to the surface of the outer base 1014. The outer base 1014 further encompasses an inner frame 1012 which is also cup-shaped, with a second abrasive grain pad 1011 attached to the surface of the inner frame 1012. A first abrasive grind pad 1013 and a second abrasive grind pad 1011 may be of different materials, formed by diamonds, or coated diamonds; and of different grain sizes, such as coarse grains (e.g., in the range of #4 to #240) or fine grains (e.g., as fine as #1000 to #4000 on the mesh scale). Wheels with smaller grain sizes generally produce smoother surfaces. Therefore the first abrasive grind pad 1013 and the second abrasive grind pad 1011 can selectively perform either coarse grinding or fine grinding on a wafer, controlled by the control unit 106. FIG. 1(*b*) illustratively shows that 1011 to be coarse grain and 1013 to be fine grain. Other options can be used too, such as the pad 1011 is fine grained and 1013 is coarse grained. The illustrative grinding wheel 101 can improve wafer output due to the reduced movement of wafers from one station to another to perform a coarse grinding followed by a fine grinding.

Both the inner frame 1012 and the outer base 1014 share a common spindle axis 102, which is attached to the 103 wheel head shown in FIG. 1(*a*). The spindle axis 102, the outer base 1014, and the inner frame 1012 all have the same center which is the center of the spindle axis, marked as a center line 1015 in FIG. 1(*b*). By sharing the same center for both the coarse grinding and the fine grinding, the Total Thickness Variation (TTV) of a wafer can be reduced. Therefore less etching chemical will be used in the next etching state, reducing the costs further.

A highly schematic representation of an exemplary grinding machine is illustrated in FIG. 1(*c*). As can be seen, both a coarse grind station and a fine grind station can be embodied in a single station, thus improving the alignment and TTV performance, as well as simplifying the machine and lowering its costs. In other embodiments, the separate buffer station could optionally be included in the single combined station as well. Controlled by the control unit 106 in the grinding system shown in FIGS. 1(*a*) and 1(*c*), the selection of a coarse grinding or a fine grinding may be accomplished by moving the inner frame 1012 vertically along the shared axis 102, up or down, or both. The selection of a coarse grinding or a fine grinding may also be accomplished by moving the outer base 1014 vertically along the shared axis 102, up or down, or both. Illustrative relative positions of the vertical movements of the inner frame 1012 and the outer base 1014 are shown in FIGS. 1(*d*), 1(*e*), and 1(*f*). FIG. 1(*d*) shows the inner frame 1012 is moved up so that when the grind wheel 101 is in contact with a wafer, only the outer base 1014 with its attached grinding pad 1013 is in contact with the wafer. FIG. 1(*e*) shows the inner frame 1012 is moved down so that when the grind wheel 101 is in contact with a wafer, only the inner frame 1012 with its attached grinding pad 1011 is in contact with the wafer. FIG. 1(*f*) further shows that both the inner frame 1012 and the outer base 1014 are in a leveled position, which is the default position when the grind wheel 101 is not performing a coarse grinding or fine grinding.

FIGS. 1(*g*)-(*h*) illustrate portions of the grinding tool of FIG. 1(*a*) from a top view. More specifically, FIGS. 1(*g*)-(*h*) illustrate the grinding wheel 101, the semiconductor wafer 201, the chuck table 202, and a turntable 203. The grinding wheel 101 is over a portion of the semiconductor wafer 201. The wafer 201 is placed on the chuck table 203 so that they both have the same center. The grinding wheel 101 is not concentric with the semiconductor wafer 201 and the chuck table 203. Instead, only a portion of the grinding wheel 101 is over the semiconductor wafer 201 and chuck table 203. To grind the semiconductor wafer 201, the grinding wheel 101 is lowered so that the appropriate grinding pad, either 1011 or 1013, or in some cases both, is in contact with only a portion of the semiconductor wafer. FIG. 1(*g*) shows the overlap of the outer base 1014 with its attached pad 1013 in contact with the wafer 201, as when the grind wheel is in position shown in FIG. 1(*d*). FIG. 1(*h*) shows the overlap of the inner frame 1012 with its attached pad 1011 in contact with the wafer 201, as when the grind wheel is in position shown in FIG. 1(*e*). The range of the overlap between the grinding wheel with either the outer metal base or the inner frame and wafer is in the range of 0-150 mm. Preferably, the overlap of the grinding pad (either 1011 or 1013) and the semiconductor wafer 201 is at most the radius of the semiconductor wafer 201, therefore reaching the center of the chuck table 203. The grinding pad (either 1011 or 1013) and the grinding chuck 202 spin so that all areas of the semiconductor wafer 201 are ground during processing.

Figure 2B:
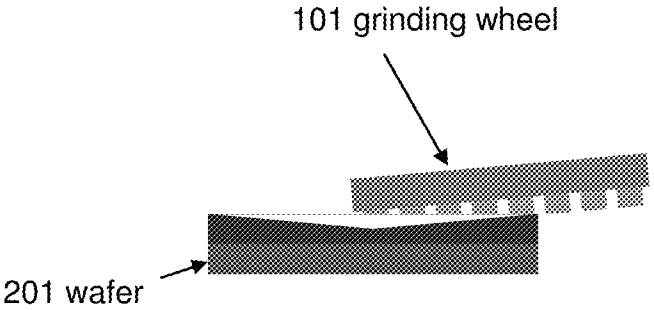
FIGS. 2 (*a*)-(*b*) are schematic views of illustrative embodiments of relative positions of a grinding wheel tilts against a wafer.
Figure 2A:
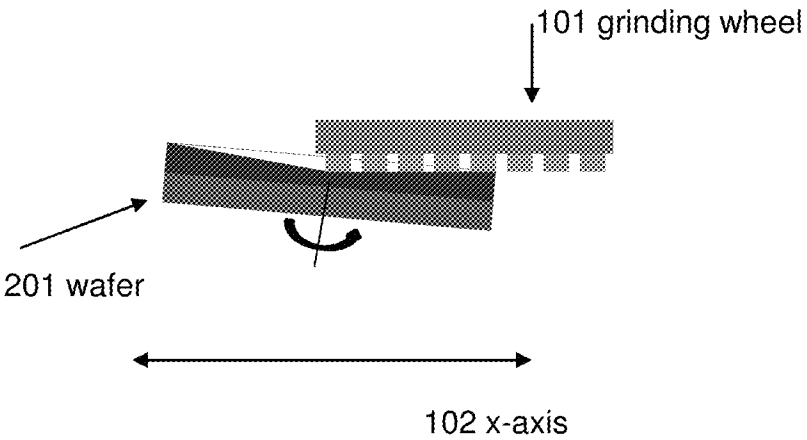

When the grinding wheel 101 is in either coarse grinding or fine grinding position, the grind wheel 101 can tilt relative the wafer 201. The tilt may be performed by tilting the axis of the wafer 201 as shown in FIG. 2(*a*), such as be tilting turn table 203, or by tilting the axis of the grinding wheel 101 as shown in FIG. 2(*b*), such as by tilting wheel head 103 and/or spindle axis 102. The grinding wheel 101 can further oscillate along the axis 102 (as shown in FIG. 2(*a*)), under control of either motor 104 and/or another control motor (not shown). This oscillating movement of the grinding head and pads along the wafer may result in a more uniform grinding process. Grinding agent can be further used (not shown) in either the coarse grinding or fine grinding process by the same grinding wheel 101.

The system shown in FIG. 1(*a*) is vertically aligned that the components move up and down to grind the wafer. An illustrative system can be horizontally aligned and the grinding wheel shown in FIG. 1(*b*) may be used in such a system as well, where the grinding wheel may move back and forth along a horizontal axis, to grind a wafer in a corresponding position. Those of skill in the art will readily recognize that there are many variations which implement equivalent functions and the illustrative embodiments are made for illustrative purpose only.

Although the present embodiments and their advantages have been described in detail, it should be understood that various changes, substitutions and alterations can be made herein without departing from the spirit and scope of the disclosure as defined by the appended claims. For example, many of the features and functions discussed above can be implemented in software, hardware, or firmware, or a combination thereof. As another example, it will be readily understood by those skilled in the art that may be varied while remaining within the scope of the present disclosure.

Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A grinding system comprising:

a grinding wheel comprising:

an outer base configured to detachably receive a first grain pad;

an inner frame encompassed within the outer base, and configured to detachably receive a second grain pad;

a spindle axis shared by the outer base and the inner frame, wherein at least one of the outer base and the inner frame can move independently along the shared spindle axis;

a control module configured to control movement of at least one of the outer base and the inner frame along the shared spindle axis;

wherein the outer base, the inner frame, and the shared spindle axis all have a same center of rotation;

a wheel head attached to the shared spindle axis of the outer base and the inner frame of the grinding wheel, capable of moving vertically;

a motor configured to drive the grinding wheel to spin; and a chuck table configured to receive a wafer thereon;

wherein the grinding wheel overlaps a portion of the chuck table, wherein the grinding wheel is configured to rotate in a first direction and the chuck table is configured to rotate in a second direction opposite the first direction, and wherein the chuck table and the spindle axis are configured to be tiltable relative one another.

2. The grinding system of claim 1, wherein the outer base of the grinding wheel overlaps an outer perimeter of the chuck table center.

3. The grinding system of claim 1, wherein the inner frame of the grinding wheel overlaps an outer perimeter of the chuck table center.

4. The grinding system of claim 1, wherein the wheel head can move down so that the outer base of the grinding wheel and the inner frame of the grinding wheel can contact the chuck table.

5. The grinding system of claim 1, further comprising a control unit that controls vertical movement of the outer base with a first attached grain pad or the inner frame with a second attached grain pad, or both, to the chuck table.

6. The grinding system of claim 1, further comprising the second grain pad attached to the inner frame of the grinding wheel and having a grain size of from #1000 to #4000.

7. The grinding system of claim 1, further comprising the first grain pad attached to the outer base of the grinding wheel and having a grain size of from #3 to #240.

8. The grinding system of claim 1, further comprising:

a buffing station.

9. The grinding system of claim 1 further comprising:

a second inner frame disposed within the inner frame and configured to detachably receive a third grain pad.

10. A grinding system comprising:

a grinding wheel comprising:

an outer base configured to detachably receive a first grain pad;

an inner frame encompassed within the outer base, and configured to detachably receive a second grain pad;

a spindle axis shared by the outer base and the inner frame, wherein at least one of the outer base and the inner frame can move independently along the shared spindle axis;

a control module configured to control movement of at least one of the outer base and the inner frame along the shared spindle axis;

wherein the outer base, the inner frame, and the shared spindle axis all have a same center of rotation;

a wheel head attached to the shared spindle axis of the outer base and the inner frame of the grinding wheel, capable of moving vertically;

a motor configured to drive the grinding wheel to spin; and a chuck table configured to receive a wafer thereon;

wherein the grinding wheel overlaps a portion of the chuck table, each capable of spinning in an opposite direction relative the other, and wherein the grinding wheel is configured for oscillating motion by moving laterally along a wafer surface while also rotating atop the wafer surface, and wherein the chuck table and the grinding wheel are configured to be tiltable relative one another.

11. The grinding system of claim 10, wherein the chuck table tilts relative the grinding wheel.

12. The grinding system of claim 10, wherein the grinding wheel tilts relative the chuck table.

13. The grinding system of claim 10, wherein the spindle axis is configured to rotate the grinding wheel one of a clockwise or counterclockwise direction and the chuck table is configured to rotate a wafer in the other of the clockwise or counterclockwise direction when the grinding wheel is in contact with the wafer.

14. The grinding system of claim 10, wherein the chuck table includes a vacuum mount for the wafer.

15. The grinding system of claim 10, wherein the chuck table is configured to rotate to bring the wafer to a different station of the grinding system.

16. A grinding system comprising:

a grinding wheel comprising:

an outer base configured to detachably receive a first grain pad having a first grain size;

an inner frame encompassed within the outer base, and configured to detachably receive a second grain pad having a second grain size different from the first grain size;

a spindle axis shared by the outer base and the inner frame, wherein at least one of the outer base and the inner frame can move independently along the shared spindle axis;

a control module configured to control movement of at least one of the outer base and the inner frame along the shared spindle axis;

wherein the outer base, the inner frame, and the shared spindle axis all have a same center of rotation;

a wheel head attached to the shared spindle axis of the outer base and the inner frame of the grinding wheel, capable of moving vertically;

a motor configured to drive the grinding wheel to spin; and a chuck table configured to receive a wafer thereon;

wherein the grinding wheel overlaps a portion of the chuck table, wherein the grinding wheel is configured to rotate in a first direction and the chuck table is configured to rotate in a second direction opposite the first direction, and wherein the chuck table and the spindle axis are configured to be tiltable relative one another.

17. The grinding system of claim 16, wherein the chuck table tilts relative the grinding wheel.

18. The grinding system of claim 16, wherein the grinding wheel tilts relative the chuck table.

19. The grinding system of claim 16, wherein the chuck table includes a vacuum mount for the wafer.

20. The grinding system of claim 16, wherein the first grain size is from #3 to #240, and wherein the second grain size is from #1000 to #4000.

* * * * *